United States Patent [19]

Fast

[11] Patent Number: 4,698,929

[45] Date of Patent: Oct. 13, 1987

[54] PRODUCT INFORMATION TAG WITH IMPROVED MOUNTING PORTION

[76] Inventor: Jacob Fast, 7561 NW. 9th St., Plantation, Fla. 33317

[21] Appl. No.: 813,143

[22] Filed: Dec. 24, 1985

Related U.S. Application Data

[63] Continuation-in-part of Ser. No. 809,789, Dec. 17, 1985, Pat. No. 4,693,024, which is a continuation-in-part of Ser. No. 562,067, Dec. 16, 1983, abandoned, which is a continuation-in-part of Ser. No. 519,226, Aug. 2, 1983, Pat. No. 4,525,944, which is a continuation-in-part of Ser. No. 473,650, Mar. 9, 1983, Pat. No. 4,531,313.

[51] Int. Cl.[4] ..... G09F 1/00

[52] U.S. Cl. ..... 40/124.1; 40/19.5; 40/20 R

[58] Field of Search ..... 40/606, 607, 124.1, 40/584, 10 R, 19.5, 19, 308

[56] References Cited

U.S. PATENT DOCUMENTS

| | | | |
|---|---|---|---|
| 3,977,109 | 8/1976 | Berry et al. | 40/124.1 |
| 4,149,630 | 4/1979 | Transport | 40/124.1 |
| 4,463,510 | 8/1984 | Windish | 40/19.5 |
| 4,525,944 | 7/1985 | Fast | 40/19.5 |
| 4,646,454 | 3/1987 | Fast | 40/124.1 |

*Primary Examiner*—Gene Mancene
*Assistant Examiner*—Wenceslao J. Contreras
*Attorney, Agent, or Firm*—Holman & Stern

[57] ABSTRACT

A product information tag for use in connection with a ladder rack-type display assembly having a product suspension hook projecting from adjacent an upright rod of a ladder rack, is formed from an elongated blank of sheet plastic which has in-line panels for folding into a depending triangular-shaped wedge at the back end of the tag, cut-outs bridging the bottom and back edges of the wedge for press-fitting the wedge respectively onto a proximal portion of the hook adjacent the rod and onto a portion of the rod adjacent the hook. The two-point press-fit type attachment provides excellent lateral stability to the tag which extends forwardly over the length of the hook to provide product information at its front end.

10 Claims, 7 Drawing Figures

PRODUCT INFORMATION TAG WITH IMPROVED MOUNTING PORTION

CROSS REFERENCE TO RELATED APPLICATIONS

This patent application is a continuation-in-part of my co-pending U.S. Patent Application entitled "PRODUCT INFORMATION TAG WITH IMPROVED MOUNTING ARRANGEMENTS", filed Dec. 17, 1985 Ser. No. 06/809,89 now U.S. Pat. No. 4693024, itself a continuation-in-part of my co-pending U.S. patent application Ser. No. 06/562,067, filed Dec. 16, 1983 for "PRODUCT INFORMATION TAG WITH IMPROVED MOUNTING ARRANGEMENT" abandoned, itself a continuation-in-part of U.S. patent application Ser. No. 06/519,226, filed Aug. 02, 1983 and entitled "IMPROVED PRODUCT IDENTIFICATION TAG", (now U.S. Pat. No. 4,525,944, issued July 02, 1985) which, in turn, is a continuation-in-part application of my co-pending U.S. patent application Ser. No. 06/473,650, filed Mar. 09, 1983 and entitled "MERCHANDISE INFORMATION TAG WITH IMPROVED MOUNTING ARRANGEMENT" (now U.S. Pat. No. 4,531,313, issued July 30, 1985). The disclosures of those patent applications are expressly incorporated herein in their entirely by this reference.

BACKGROUND OF THE INVENTION

The present invention relates to product identification and information tags for merchandise suspended from horizontally-extending support hooks, and the like. More particularly, the invention relates to such tags which are easily attached to and removed from support hooks without being subject to inadvertent removal, and which display product information forwardly of the supported merchandise.

In my aforesaid U.S. patents, I disclose a merchandise information display tag formed from a plastic sheet which displays product information forwardly of items suspended from a horizontally-extending hook. The tag has a mounting portion by which it is secured to the proximal end of the hook, a distal or display portion which folds down over the distal end of the hook, and an intermediate portion which extends horizontally between the mounting and display portions above the hook and the suspended merchandise items. The mounting portions of the tags disclosed in the aforesaid patents are configured to engage the proximal ends of various support hooks designed to be suspended on an apertured board. Such mounting portions are designed to be easily deployed on and removed from the support hook but cannot be inadvertently removed or fall from the hook once the display tag has been deployed.

I have found that the display tags disclosed in my aforesaid patents are not optimally suited for mounting on certain types of support hooks which are suspended from structures other than an apertured board. For example, luncheon meat packages in supermarkets are generally suspended from hooks which have their proximal ends mounted on an angle iron support. The angle iron support opens upwardly and the support hook has its proximal end extending through and supported by apertures in the respective limbs of the angle iron support. The mounting portions of display tags in accordance with the aforesaid patents are not configured for mounting on a support hook-angle iron support assembly of this nature. However, the parent application discloses display tags having mounting portions which are particularly adapted to this purpose. Broadly stated, the mounting portions of the display tags according to the parent application comprise at least two (2) panels which can be folded transversely to conform to the angle between the respective limbs of the angle iron support. The panels have respective apertures on the center line of the tag and a cut extending between the apertures along the center line and across a transverse fold line forming a junction between the panels. This construction allows the mounting portion to be press-fitted into engagement with the proximal portion of the support hook located within the angle iron support. In one preferred form of the invention disclosed in the parent application, the mounting portions comprises four (4) in-line panels which are folded into a triangular depending wedge with the last panel underlying the first panel, the two (2) intermediate panels forming downwardly inclined diverging limbs of the wedge, the fold line between these two (2) panels forming the apex of the wedge, and the apertures and cut bridging the apex. The first and last panels are connected by aligned push-down tabs scored therein to stabilize the wedge.

Another form of support hook for which display tags having mounting portions disclosed in the aforesaid patents are not optimally suited is a hook which forms part of a display assembly commonly used for displaying brooms and mops and associated suspended card-type hardware such as brushes, sponges, scrubbing utensils, and like cleaning items. A display assembly of this type commonly comprises a vertical ladder rack-type support and brackets each including a pair of laterally spaced elongate support hooks for attachment to the vertical support. Typically, the vertical support is of a welded wire rod-type construction with laterally spaced uprights, each comprising a front rod and a back rod, and laterally extending vertically spaced ladder rods between the uprights, the end portions of the ladder rods being captivally welded between the front and back rods of the respective uprights. Each bracket comprises an upper lateral rod welded across the top of the support hooks, and a lower forwardly spaced lateral rod welded across the bottom of the support hooks. A bracket can be manipulated into engagement with the ladder rack support so that the hooks are supported cantilever-wise from the ladder rack on one of the lader rods adjacent the respective uprights, with the upper lateral rod of the bracket engaging the back of the uprights and the lower lateral rod of the bracket engaging the front of the uprights. In use, brooms or mops are stood vertically on end betweent the hooks, and carded hardward items are suspended from the hooks.

It is a particular object of the present invention to provide a merchandise display tag of the general character described above, which has a mounting portion suitable for attachment of the tag in a stabilized manner to the proximal ends of support hooks attached to ladder rack supports of the type described, to enable product information to be displayed forwardly of the hooks in like manner to the arrangements disclosed in my aforesaid patents and patent applications.

SUMMARY OF THE INVENTION

A plastic merchandise information and display tag in accordance with the invention, generally of the type discussed above, has a mounting portion defined by four (4) in-line panels separated by transverse fold lines for folding into a depending triangular shaped wedge in similar manner to the mounting portion disclosed in the parent application, with aligned push-down tabs on the first and last panels for stabilizing the wedge, and with a first cut-out defining apertures in the two (2) central panels and a length-wise cut extending between the apertures across the fold line between the panels (in use the apex of the wedge) to provide means whereby the mounting portion can be resiliently press-fitted onto the proximal end of a support hook extending on a bracket from a ladder rack support as described. In this case, however, the mounting portion has a further cut-out defining press-fit forming apertures in the first and second panels joined by another length-wise cut extending across the fold line between the first and second panels, the further apertures and cut being laterally offset from the first apertures and cut, and the last panel including a still further press-fit aperture extending inwardly from its terminal edge to align with the further apertures when the last panel is folded under the first panel to form the wedge. The further apertures thus form a press-fit opening at the back of the wedge for press-fitting onto one of the rods of the ladder rack upright adjacent the support hook when the wedge is fitted onto the hook, so that the tag is effectively stabilized by a laterally offset two-point press-fit attachment of its mounting portion.

As in the parent application, the mounting portion cn be folded into a wedge in either direction (up or down) with respect to the main body of a tag blank so that it is effectively reversably usable on support hooks at opposite sides of a ladder rack support.

Additional features and advantages of the present invention will become apparent from the ensuing description and claims taken in conjunction with the attached drawings.

DESCRIPTION OF THE PREFERRED EMBODIMENT

Figure 1:
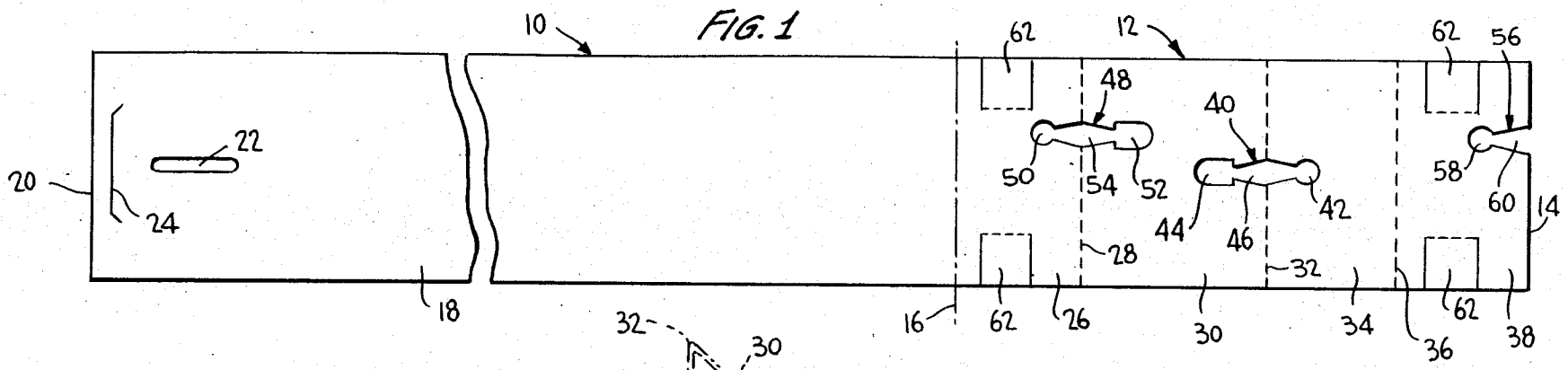
FIG. 1 is a plan view of a plastic blank for a merchandise information and display tag in accordance with the invention.

Referring initially to FIG. 1, an elongated rectangular blank 10 for a merchandise information and display tag in accordance with the invention may be die-cut from a plastic sheet and formed with a mounting portion 12 extending from a proximal or back edge 14 of the blank to an imaginary transverse line 16 across the blank, and a main body portion 18 extending from line 16 to a front or distal edge 20 of the blank. Toward the front edge 20, portion 18 of the tag is formed with an elongated slot 22 for receiving the distal end of a product suspension hook as more fully described in the above-noted patents and applications. Between slot 22 and edge 20, the tag is provided with a transverse slit 24 for receipt of a separate product information display element (not shown) as disclosed in applicant's co-pending application Ser. No. 719,116, filed Apr. 12, 1985 for "IMPROVEMENTS RELATING TO PRODUCT IDENTIFICATION TAGS", and the disclosure of which is also expressly incorporated herein by reference. It is to be understood, however, that in place of a separate display element, tag 10 could alternatively be provided with an integral fold-down information display portion at its forward end.

The mounting portion 12 of blank 10 comprises a first panel 26 extending from imaginary line 16 to a first fold line 28 scored transversely across the width of the blank, a second panel 30 extending from fold line 28 to a second like fold line 32, a third panel 34 extending from line 32 to a third transverse fold line 36, and a fourth panel 38 extending from line 36 to back edge 14 of the blank. Further, the mounting portion is formed with a first die-cut or like cut-out 40 comprising a circular aperture 42 in panel 34, an elongated aperture 44 in panel 30, and a longitudinal slot 46 extending between the apertures across fold line 28. It will be noted that the sides of slot 46 diverge from the respective apertures toward fold line 32. The apertures and slot are preferably centered on the longitudinal axis of the blank.

Mounting portion 12 is also formed with a second cut-out 48 similar to cut-out 40 in reverse and laterally offset from cut-out 40. Thus, cut-out 48 has a circular aperture 50 in panel 26, an elongate aperture 52 in panel 30 and a connecting slot 54 with diverging sides extending between the apertures across fold line 28.

A third cut-out 56 is provided in panel 38 of the mounting portion in line with cut-out 48 and comprising a circular aperture 58 conforming with aperture 50 and a slot 60 opening into edge 14 and conforming to the distal portion of slot 54.

Figure 2:
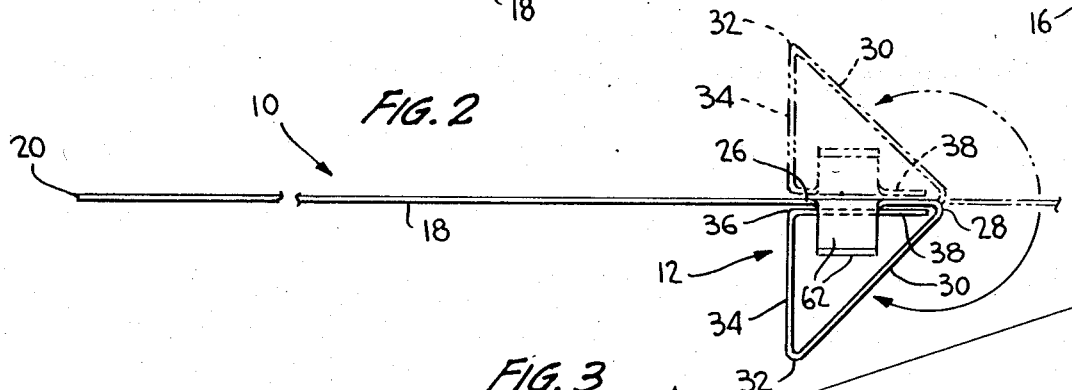
FIG. 2 is an elevational view of a back section of the tag showing how a mounting portion thereof may be formed into a wedge.
Figure 3:
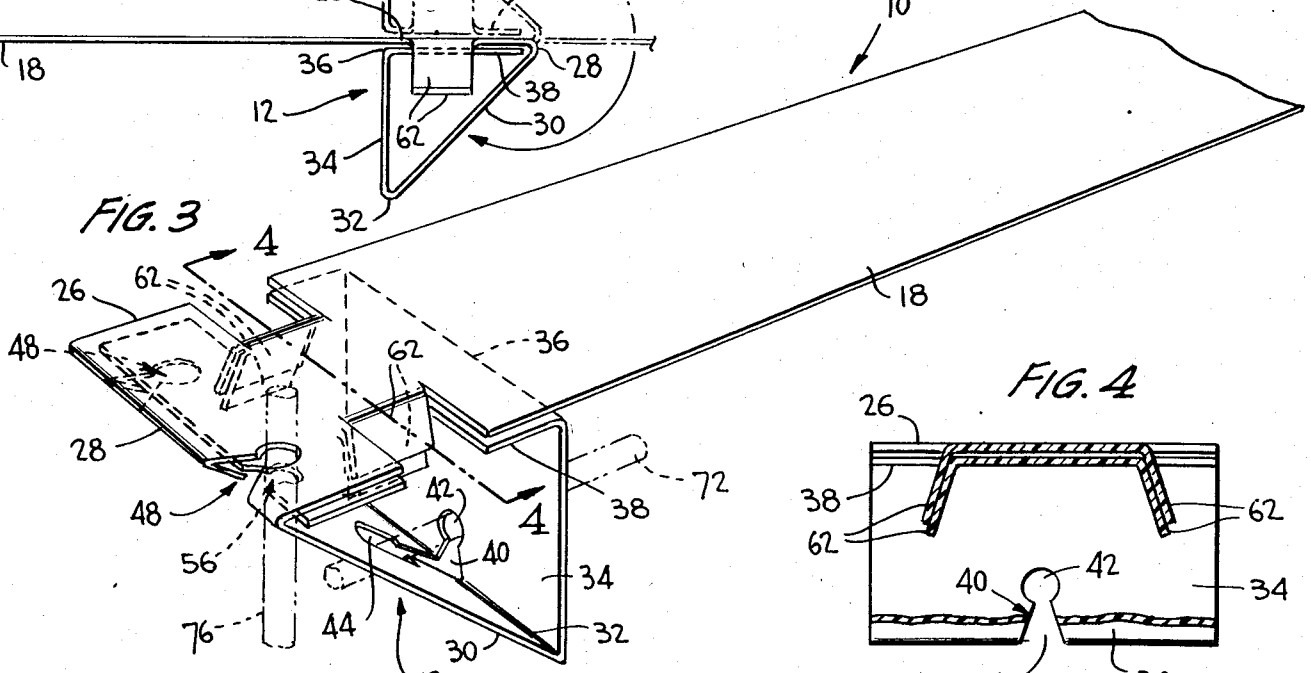
FIG. 3 is a perspective view of the back portion of the tag.

Panels 30, 34 and 38 can be folded about the respective fold lines 28, 32 and 26 in either direction, as shown in FIG. 2, so as to form the mounting portion into a triangular-shaped wedge with panel 38 lying over or under panel 26, panels 30, 34 providing inclined diverging limbs of the wedge and fold line 32 forming the apex of the wedge. It will be noted that when the mounting portion is folded, cut-out 56 registers with folded cut-out 54 at the back edge of the tag (as seen most clearly in FIG. 3). Also, the lengths of the respective panels are such that when folded, panel 34 is disposed substantially perpendicular with respect to panel 26 and main body portion 18 of the tag. Depending on the direction of folding of the mounting portion (FIG. 2) into a wedge, when the main body 18 of the tag is brought to the top, the registering cut-outs 48 and 56 will be offset laterally either to the left or right of cut-out 40. Panels 26 and 38 are provided with cut and scored push-down side tabs 62 which align when the panels are folded into a wedge for pressing down in unison to stabilize the wedge.

Figure 5:
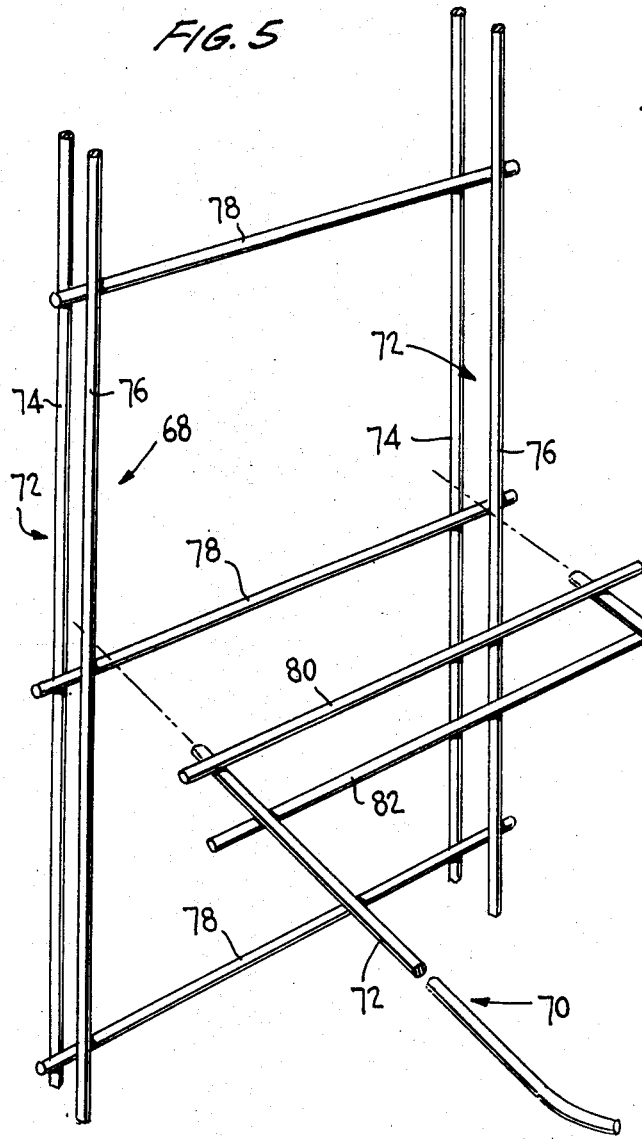
FIG. 5 is an exploded view of a ladder rack-type display assembly with which the tag is to be used.
Figure 7:
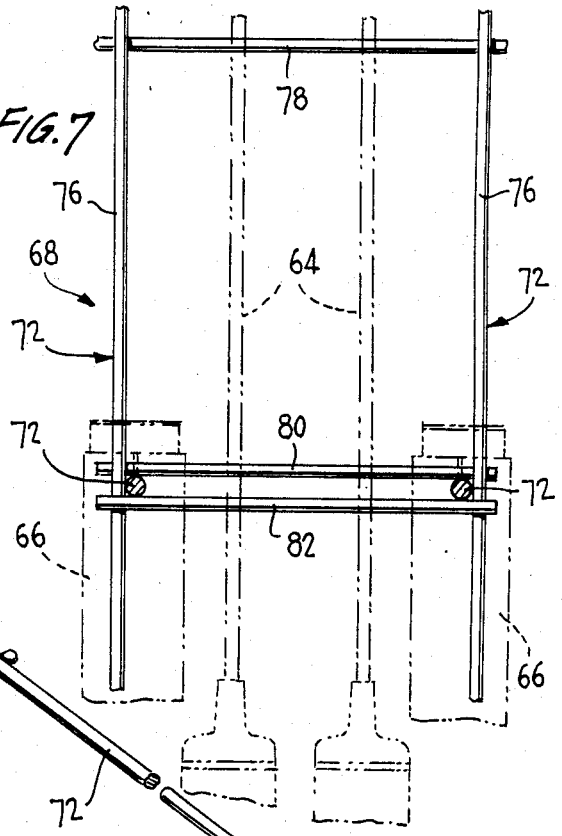
FIG. 7 is a sectional view on line 7—7 of FIG. 6.
Figure 6:
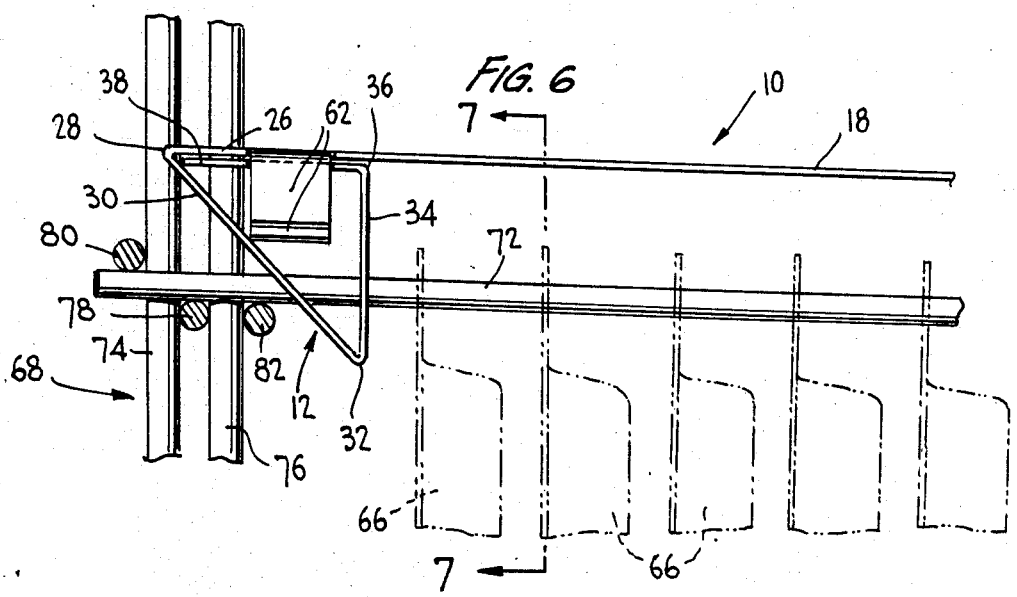
FIG. 6 is a side elevational view of the tag as mounted on the display assembly.

The information tag thus far described is particularly suited for use with a display assembly of the type shown in FIGS. 5–7 and which is of the type commonly used for displaying brooms or mops 64 and related hardware items 66 on apertured cards and the like. The display assembly includes a ladder rack-type support element 68 suitably supported in upright position and a bracket element 70 including a pair of laterally spaced elongated product support hooks 72. Both the ladder rack support element and the bracket may be fabricated of wire rod.

Support element 68 comprises left hand and right hand uprights 72 each formed with a back rod 74 and a front rod 76, and a series of vertically spaced laterally extending ladder rods 78 extending between the uprights and captively welded toward their opposite ends between the back and front rods of the respective uprights. Bracket element 70 includes an upper lateral rod 80 welded across the top of hooks 72 at their back or proximal ends, and a lower lateral rod 82 welded across the bottom of hooks 72 somewhat forwardly of rod 80. The respective ends of rods 80 and 82 project laterally somewhat beyond hooks 72. Bracket 70 can be manipulated, by tilting the bracket, into support element 68 and brought to rest with hooks 72 on top of one of the ladder rods 78 (see FIG. 6) immediately inside of the respective uprights 72, with upper rod 80 engaged behind the back rods 74 of the uprights 72, and with lower rod 82 engaged in the front of front rods 76 of the uprights, whereby the bracket is supported on element 68 with hooks 72 extending cantilever-wise from the ladder rack element. In use, the brooms or mops 64 may be stacked vertically on end between hooks 72, and the carded items 66 may be suspended from the hooks.

Figure 4:
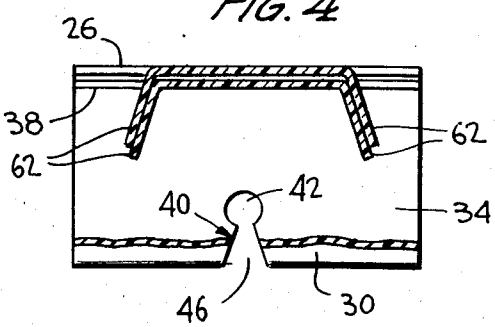
FIG. 4 is a sectional view on line 4—4 of FIG. 3.

The information display tag 10 with product information element attached to slit 24 and with mounting portion 12 folded and stabilized into the aforesaid wedge can be mounted on the display assembly, as shown most clearly in FIGS. 4 and 6, by press-fitting cut-out 46 over the proximal end portion of one of the hooks 72 and similarly press-fitting the registering cut-outs 48 and 56, from the front, onto the front rod 76 of the adjacent upright 72, the wedge having been folded to suit either a left or right hand upright as the case may be. It will, of course, be understood that the cut-outs are configured and dimensioned specifically to press-fit or "snap" onto the respective hook and front rod and are laterally spaced accordingly.

The laterally spaced, two-point press-fit-type of attachement of the mounting portion of the tag on the display assembly provides excellent lateral stability to the tag which extends forwardly over the suspended products and presents information relative thereto at a forward end of the hook by means of a suitable label on the attached display element. The tag can be eased off of the display assembly, when required for re-use.

While only a preferred embodiment of the invention has been described herein in detail, the invention is not limited thereby and modifications can be made within the scope of the attached claims.

I claim:

1. A product information tag for use with a display assembly having an upright rod and a product suspension hook extending cantilever-wise from the assembly adjacent the rod, the tag comprising an elongated member of sheet material having a mounting portion for attachement to the display assembly at a junction between the rod and hook, and a main body portion extending from the mounting portion for projecting over the hook and presenting product information at a forward end thereof, wherein the mounting portion comprises plural in-line panels mutually foldable transversely of the tag into a depending triangular-shaped wedge having a back edge and a bottom edge defining an apex of the wedge, the panels having a first cut-out spanning the apex of the wedge for press-fitting onto a proximal portion of the hook adjacent said rod, and second cut-out spanning of the back edge of the wedge and laterally spaced from the first cut-out for press-fitting onto the rod.

2. A product information tag as defined in claim 1, wherein the first cut-out is located substantially on a longitudinal center line of the tag and the panels can be folded into the wedge selectively in opposite directions with respect to the main body portion of the tag to locate the second cut-out selectively to the left and right of the first cut-out.

3. A product information tag as defined in claim 1, wherein the panels are separated by transverse fold lines and each cut-out comprises a first aperture in one of the panels, a second aperture in an adjacent panel, and a slot extending between the apertures across the fold lines separating the respective panels, the slot having an enlarged cross-section on the fold line and a reduced cross-section at its junction with each aperture forming a neck at said junction.

4. A product information tag as defined in claim 1, wherein the panels are configured for folding into a wedge having one depending limb remote from the back edge which is defined by one of the panels disposed substantially perpendicularly to the main body portion of the tag.

5. A product information tag as defined in claim 1, wherein the panels are four in number consisting of a first panel adjacent the main body portion of the tag, second and third panels for forming converging dependent limbs of the wedge, and a fourth panel for folding under the first panel, wherein the first and fourth panels have respective push-down side tabs positioned for mutual registration when the mounting portion is folded into a wedge and folding down in unison to stabilize the wedge.

6. A product information tag as defined in claim 5, wherein the fourth panel has a free transverse edge and a third cut-out extending inwardly from said edge for registration with a part of the second cut-out when the panels are folded to form a wedge.

7. An elongate rectangular blank of plastic sheet for folding into a product information tag, the blank having a forward end and a back end, a first transverse fold line formed across the sheet further away from the forward end than from the back end, a second transverse fold line formed across the sheet between the first fold line and the back end of the sheet, a third transverse fold line formed across the sheet between the second fold line and the back end of the sheet, a first longitudinally extending cut-out in the sheet bridging the second fold line, the first cut-out having aperture portions at its opposite ends and a cut connecting the aperture portions extending across the second fold line, a second longitudinally extending cut-out laterally spaced from the first cut-out and bridging the first transverse fold line, the second cut-out also having aperture portions at its opposite ends connected by a cut extending across the first fold line, a first push-down side tab formed in the sheet adjacent the first transverse fold line between the the first transverse fold line and the front end of the sheet, and a second push-down side tab of like size to the first tab formed in the sheet between the third transverse fold line and the back end of the sheet.

8. A blank as defined in claim 7, wherein the first tab is spaced from the first transverse fold line by an equal amount as the second tab is spaced from the back end of the sheet, and wherein the sheet has a third cut-out aligned with the second cut-out, the third cut-out being substantially of equal shape to a portion of the second cut-out which extends from the first fold line toward the front end of the sheet, and the third cut-out extending inwardly from the back end of the sheet.

9. A blank as defined in claim 7, wherein the cuts of the respective cut-outs comprise slots which diverge from the respective aperture portions of the cut-outs toward the respective fold lines.

10. A blank as defined in claim 7, wherein the first cut is located substantially on the longitudinal center line of the blank.

* * * * *